US007648134B2

(12) United States Patent
Lim

(10) Patent No.: US 7,648,134 B2
(45) Date of Patent: Jan. 19, 2010

(54) PAPER SUPPLY DEVICE AND IMAGE FORMING APPARATUS HAVING THE SAME

(75) Inventor: Kwang Taek Lim, Gwangmyeong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/055,374

(22) Filed: Mar. 26, 2008

(65) Prior Publication Data

US 2009/0014940 A1 Jan. 15, 2009

(30) Foreign Application Priority Data

Jul. 13, 2007 (KR) ..... 10-2007-0070523

(51) Int. Cl.
*B65H 3/06* (2006.01)
*B65H 1/08* (2006.01)

(52) U.S. Cl. ..... 271/118; 271/124; 271/117; 271/121

(58) Field of Classification Search ..... 271/114, 271/115, 113, 117, 118, 157, 121, 124, 126, 271/127
See application file for complete search history.

(56) References Cited

U.S. PATENT DOCUMENTS 5,052,673 A * 10/1991 Tokuda et al. ..... 271/22
5,193,797 A * 3/1993 Harada et al. ..... 271/115
5,547,181 A * 8/1996 Underwood ..... 271/114
5,678,814 A * 10/1997 Yokoyama et al. ..... 271/9.05
5,720,477 A * 2/1998 Morita et al. ..... 271/117
6,073,923 A * 6/2000 Lin et al. ..... 271/10.03
6,328,301 B1 * 12/2001 Tsujii et al. ..... 271/117
6,994,341 B2 * 2/2006 Aoki et al. ..... 271/117
7,457,580 B2 * 11/2008 Kitamura ..... 399/393
2001/0010414 A1 * 8/2001 Yukimachi ..... 271/9.11
2003/0116906 A1 * 6/2003 Amamoto ..... 271/126
2005/0179192 A1 * 8/2005 Miura et al. ..... 271/118
2006/0255530 A1 * 11/2006 Ma ..... 271/126

FOREIGN PATENT DOCUMENTS

JP 2006-8343 1/2006

* cited by examiner

*Primary Examiner*—Patrick H Mackey
*Assistant Examiner*—Patrick Cicchino
(74) *Attorney, Agent, or Firm*—Stein McEwen, LLP

(57) ABSTRACT

A paper supply device and an image forming apparatus, capable of always maintaining a constant pickup force regardless of the amount of loaded sheets of paper. The paper supply device includes a paper supply cassette, a pickup unit to pick up the paper, a paper supply plate and a press spring to bias the paper toward the pickup unit, a first restraining device to restrain the paper supply plate and to release the restraint of the paper supply plate, a second restraining device to permit the pickup unit to move vertically when the pickup unit picks up the paper and restricts the vertical movement of the pickup unit when the pickup unit does not pick up the paper, and an elastic member to bias the pickup unit toward the paper to provide the pickup unit with a pickup force when the pickup unit picks up the paper.

18 Claims, 6 Drawing Sheets

PAPER SUPPLY DEVICE AND IMAGE FORMING APPARATUS HAVING THE SAME

CROSS-REFERENCE TO RELATED APPLICATIONS

This application claims all benefits accruing under 35 U.S.C. §119 from Korean Patent Application No. 2007-70523, filed in the Korean Intellectual Property Office on Jul. 13, 2007, the disclosure of which is incorporated herein by reference.

BACKGROUND OF THE INVENTION

1. Field of the Invention

Aspects of the present invention relate to a paper supply device to supply printable medium to a main body of an image forming apparatus, and an image forming apparatus having the same.

2. Related Art

An image forming apparatus, such as a copying machine, a fax machine or a printer, includes a paper supply device to supply paper into a main body. Typically, the paper supply device picks up the loaded paper sheet by sheet, and supplies the paper into a main body of the image forming apparatus. As used herein, "paper" refers to any medium onto which an image may be printed, including paper, thermal paper, and transparent film.

Japanese Laid-Open Patent Publication No. 2006-8343 (published on Jan. 12, 2006) discloses an image forming apparatus with a paper supply device. The paper supply device of the disclosed image forming apparatus includes a pickup roller to pick up the paper loaded in a paper cassette, a paper supply roller, and a spring to push up a paper supply plate loaded with the paper toward the pickup roller. The paper supply device further includes a lifting device, which, if the amount of loaded paper decreases as the paper is supplied to the main body, moves the paper supply plate toward the pickup roller so that the uppermost paper contacts the pickup roller.

The lifting device includes a planetary gear coupled to the paper supply plate, an internal gear engaged with the planetary gear and coupled to a frame of the paper supply device, a sun gear engaged with the planetary gear, a ratchet rotating coaxially with the sun gear, and a restraining member restraining or releasing the ratchet. The restraining member includes a locking lever that is latched by the ratchet, a spring biasing the locking lever, and a solenoid device that releases the locking lever from the ratchet.

The pickup roller and the paper supply roller are rotatably supported by a pickup frame in the main body. The pickup frame moves up and down within a predetermined region so that a position of the pickup roller changes according to a height of the loaded sheets of paper. A height sensor is mounted near the pickup frame to sense a height of the pickup frame. The solenoid device of the restraining member is controlled based on a sensing signal from the height sensor for the position of the pickup frame. If the pickup roller moves down, the solenoid device operates the locking lever to be released from the ratchet, and the paper supply plate is biased upward by an elastic force of the spring mounted below. The planetary gear moves up by revolving around the sun gear by the rotation of the sun gear, thereby moving up the paper supply plate.

The loaded sheets of paper move up by the lifting force of the paper supply plate. If the uppermost paper pushes up the pickup roller, the pickup frame also moves up. If the pickup frame moves up, the height sensor senses the movement of the pickup frame, and the operation of the solenoid device is stopped, so that the locking lever restrains the ratchet. If the ratchet is restrained, the rising of the paper supply plate is stopped.

The above conventional paper supply device is configured such that when the paper is picked up, the rising force created by the spring pushing up the paper supply plate is applied to the pickup roller through the loaded sheets of paper. However, because the rising force changes according to the amount of loaded sheets of paper on the paper supply plate, a pickup force is not constant. Because the rising force of the spring changes according to the amount of loaded sheets of paper and the weight of the loaded sheets of paper, the pickup force is not constant.

Further, because the lifting device to push up the paper supply plate includes the internal gear, the planetary gear, the sun gear, the ratchet, the locking lever, the solenoid device, the height sensor, etc., the above conventional paper supply device has a great number of components and complicated constitution of the components.

SUMMARY OF THE INVENTION

Aspect of the present invention provide a paper supply device and an image forming apparatus having the same that is capable of always maintaining a constant pickup force regardless of the amount of loaded sheets of paper.

Additional aspects of the invention provide a paper supply device and an image forming apparatus having the same that is capable of more simplifying a device of adjusting a height of a paper supply plate than a conventional device.

Additional aspects and/or advantages of the invention will be set forth in part in the description which follows and, in part, will be obvious from the description, or may be learned by practice of the invention.

According to an aspect of the invention, a paper supply device is provided. The paper supply device comprises a paper supply cassette to load a printable medium; a pickup unit to pick up the printable medium loaded in the paper supply cassette sheet by sheet; a paper supply plate and a press spring arranged to bias the loaded printable medium toward the pickup unit; at least one first restraining device to restrain the paper supply plate when the pickup unit picks up the printable medium and to release the paper supply plate when the pickup unit does not pick up the printable medium; a second restraining device to permit the pickup unit to move up and down when the pickup unit picks up the printable medium and to restrict the up/down movement of the pickup unit when the pickup unit does not pick up the printable medium; and an elastic member to bias the pickup unit toward the printable medium so as to provide the pickup unit with a pickup force when the pickup unit picks up the printable medium.

According to another aspect of the present invention, the pickup unit includes a rotating shaft rotating by a driving source, a paper supply roller coupled to the rotating shaft, a pickup roller disposed above the printable medium at a distance from the paper supply roller to pick up the printable medium in conjunction with the paper supply roller, a pickup frame to support the pickup roller and to rotate on the rotating shaft so as to move the pickup roller up and down, and a lifting member connected to the pickup frame or a shaft of the pickup roller and biased toward the paper by the elastic member so as to move the pickup roller up and down.

According to another aspect of the present invention, the first restraining device includes a first rotating cam coupled to the rotating shaft, a lifting cam to move up and down by operation of the first rotating cam, a first restoring spring to bias the lifting cam toward the first rotating cam, an advancing/retreating member to advance and retreat in a direction perpendicular to the lifting cam according to the up/down movement of the lifting cam and having a tooth part extending vertically to restrain the paper supply plate, and a latching part provided at the paper supply plate so as to be latched by or released from the tooth part according to operation of the advancing/retreating member so as to restrain or release the paper supply plate.

According to another aspect of the present invention, the lifting cam includes at least one inclined slot having an inclination with respect to an up/down moving direction, and the advancing/retreating member includes at least one protrusion that is fitted into the inclined slot.

According to another aspect of the present invention, the first restraining device includes a plurality of first restraining devices respectively provided at two sides of the paper supply cassette.

According to another aspect of the present invention, the second restraining device includes a second rotating cam coupled to the rotating shaft, a restraining member to advance and retreat by operation of the second rotating cam and having a restraining protrusion to restrain or release the lifting member, a second restoring spring to bias the restraining member toward the second rotating cam, and a restraining recess formed at the lifting member so as to allow the restraining protrusion to fit into the restraining recess to be latched.

According to another aspect of the present invention, the restraining recess is provided with inclined guide surfaces formed at an opening of the restraining recess while being inclined so as to have an expanded opening to ensure smooth fitting of the restraining protrusion.

According to another aspect of the present invention, the pickup unit includes a plurality of gears to transmit a rotational force of the paper supply roller to the pickup roller, and oneway clutches provided at a coupling portion of the rotating shaft and the paper supply roller and a connecting portion of the pickup roller and the plurality of gears.

According to another aspect of the invention, an image forming apparatus is provided. The image forming apparatus comprises an image forming unit to form an image onto a printable medium; and a paper supply device to supply the printable medium to the image forming unit, the paper supply device including a paper supply cassette to load the printable medium, a pickup unit to pick up the printable medium loaded in the paper supply cassette sheet by sheet, a paper supply plate and a press spring to bias the loaded printable medium toward the pickup unit, a first restraining device to restrain the paper supply plate when the pickup unit picks up the printable medium and release the paper supply plate when the pickup unit does not pick up the printable medium, a second restraining device to permit the pickup unit to move up and down when the pickup unit picks up the printable medium and to restrict the movement of the pickup unit when the pickup unit does not pick up the printable medium, and an elastic member to bias the pickup unit toward the printable medium so as to provide the pickup unit with a pickup force when the pickup unit picks up the printable medium.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
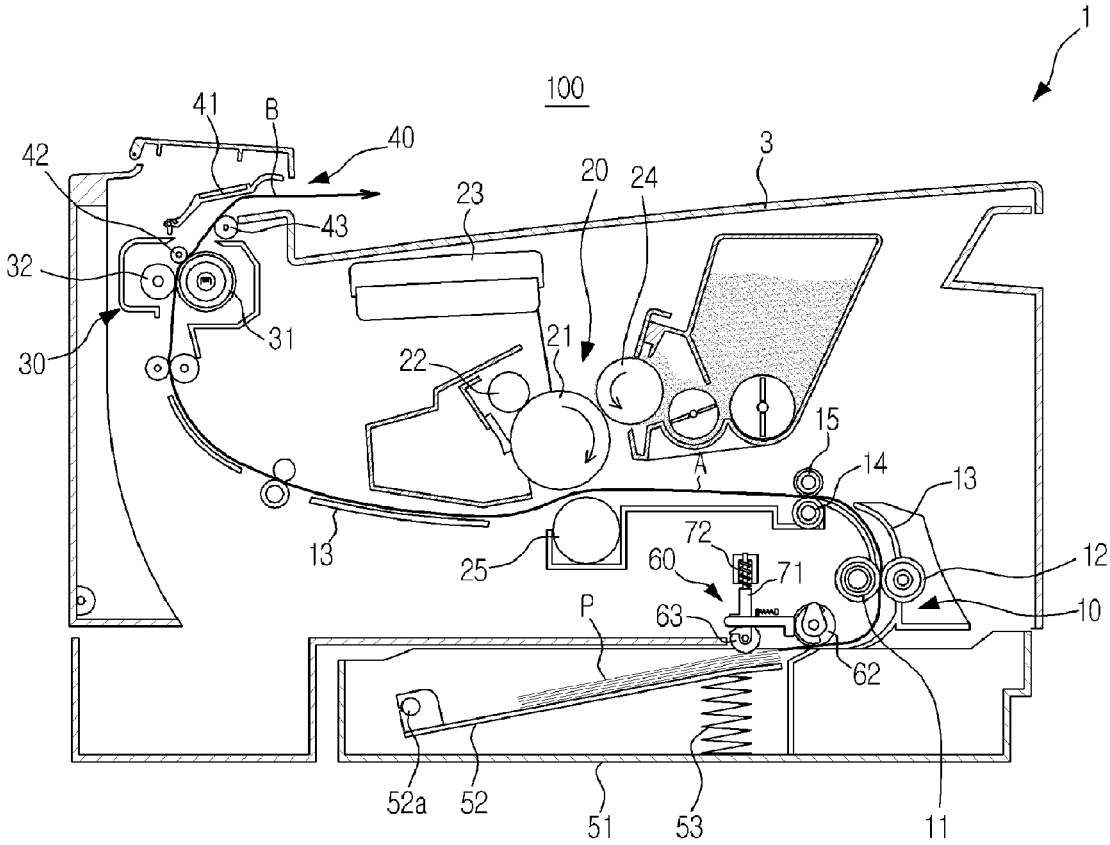
FIG. 1 is a sectional view illustrating an image forming apparatus according to an example embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 shows a schematic constitution of an image forming apparatus 100 according to an example embodiment of the present invention. The image forming apparatus 100 includes a paper supply device 50 to store paper P therein, a feeding unit 10 to feed the paper P, an image forming unit 20 to form an image on the paper P, a fusing unit 30 to fuse the transferred image to the paper, and a paper discharge unit 40 to discharge the paper. According to other aspects of the invention, the image forming apparatus may include additional and/or different units. Similarly, the functionality of two or more of the above units may be combined into a single component. In addition, although described herein with respect to paper, any printable medium may be used, such as paper, thermal paper, or transparent film.

A pickup unit 60 picks up the paper loaded in the paper supply device 50 sheet by sheet, and supplies the paper toward the feeding unit 10. A detailed constitution of the paper supply device 50 will be described later.

The feeding unit 10 feeds the paper picked up by the pickup unit to a print path A. The feeding unit 10 includes a feeding roller 11, a feeding backup roller 12, a feeding guide 13 that forms the print path A, a register roller 14, and a register backup roller 15, which registers the front end of the fed paper.

The image forming unit 20 includes a photosensitive roller 21, a charge roller 22, and a laser scanning unit (LSU) 23. The photosensitive roller 21 is positioned in the print path A. The charge roller 22 charges the photosensitive roller 21. The laser scanning unit (LSU) 23 irradiates a laser beam to the charged photosensitive roller 21 according to an image signal so as to form an electrostatic latent image on the surface of the photosensitive roller 21. The image forming unit 20 further includes a developing roller 24 and a transfer roller 25. The developing roller 24 supplies a developer to the electrostatic latent image formed on the photosensitive roller 21 to form a visible image. The transfer roller 25 transfers the visible image formed on the photosensitive roller 21 onto the paper. The photosensitive roller 21 charged by the charge roller 22 assumes a negative charge. The electrostatic latent image is formed on the surface of the photosensitive roller 21 by the laser beam irradiated from the LSU 23. The developing roller 24 supplies the developer having a negative charge to the electrostatic latent image on the photosensitive roller 21 to form the visible image. The transfer roller 25 having a positive charge transfers the developer adhering to the photosensitive roller 21 onto the paper.

The fusing unit 30 is disposed near an outlet of the print path A. The fusing unit 30 includes a heat roller 31 and a press roller 32. While the paper passes between the heat roller 31 and the press roller 32, the fusing unit 30 applies heat and pressure to the developer (image) transferred onto the paper so that the developer is fused onto the paper.

The paper discharge unit 40 feeds the paper, which has passed by the fusing unit 30, to a paper discharge part 3 provided on an upper portion of a main body 1. The paper discharge unit 40 includes a paper guide member 41 that is mounted above the fusing unit 30 and guides the paper to the paper discharge part 3, and plural discharge rollers 42 and 43 that are disposed in a discharge path B.

Figure 2:
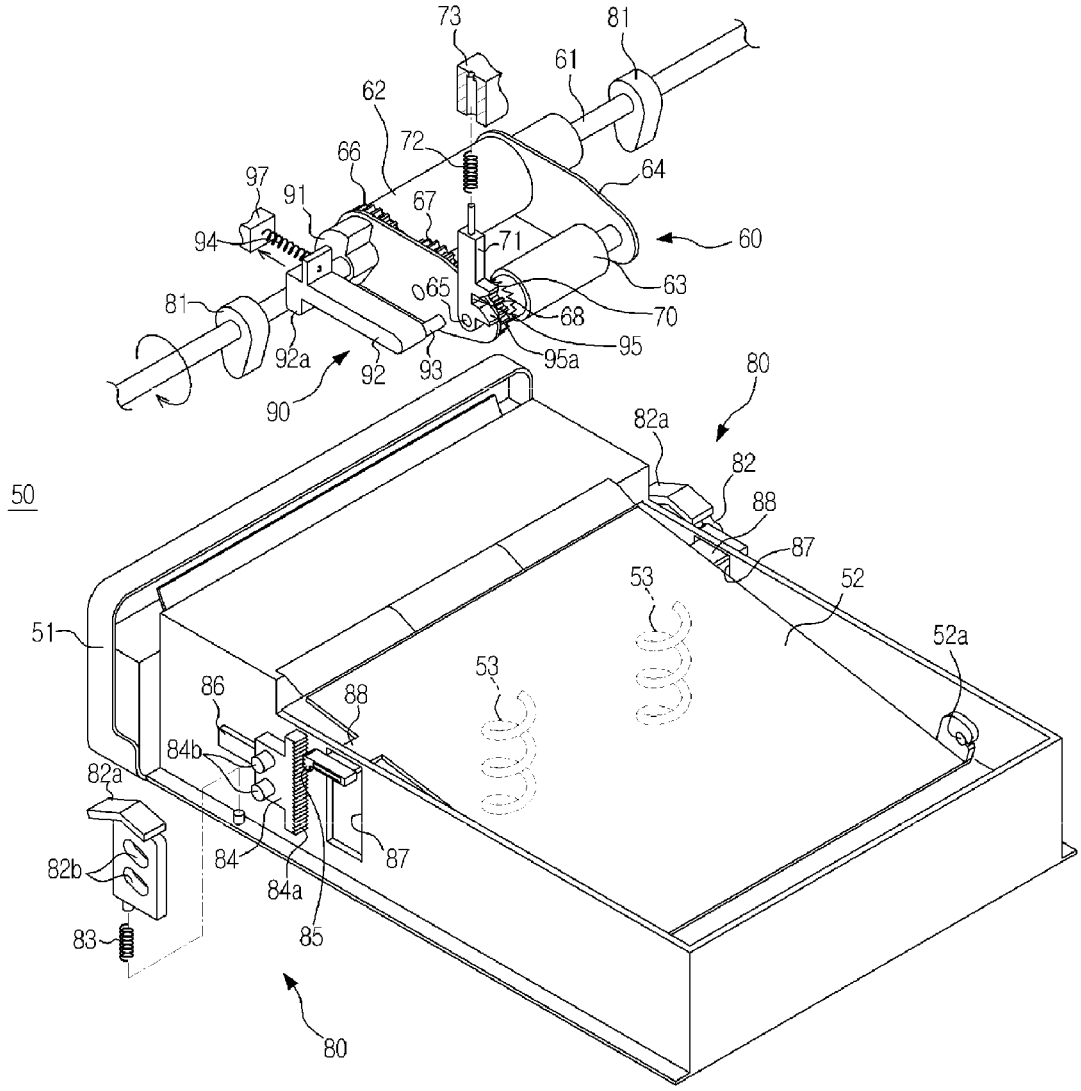
FIG. 2 is an exploded perspective view of a paper supply device according to an example embodiment of the present invention.

As shown in FIG. 2, the paper supply device 50 provided in a lower portion of the main body 1 includes a paper supply cassette 51 that is removably mounted in the lower portion of the main body 1, and a pickup unit 60 provided above the paper supply cassette 51. Because the pickup unit 60 is fixedly mounted in the main body 1, the pickup unit 60 remains inside the main body 1, even when removing the paper supply cassette 51 from the main body 1 to add paper.

A paper supply plate 52 and plural press springs 53 are mounted inside the paper supply cassette 51. The press springs 53 are disposed under the paper supply plate 52 to bias the paper supply plate 52 toward the pickup unit 60. One end of the paper supply plate 52 is hingedly coupled to the paper supply cassette 51 by hinge pins 52*a*. The other end portion of the paper supply plate 52 is supported by the press springs 53 from below. Since the paper loaded on the paper supply plate 52 is applied with a rising force by the press springs 53, the paper is pushed up toward the pickup unit 60, and can be picked up sheet by sheet by the pickup unit 60.

Figure 3:
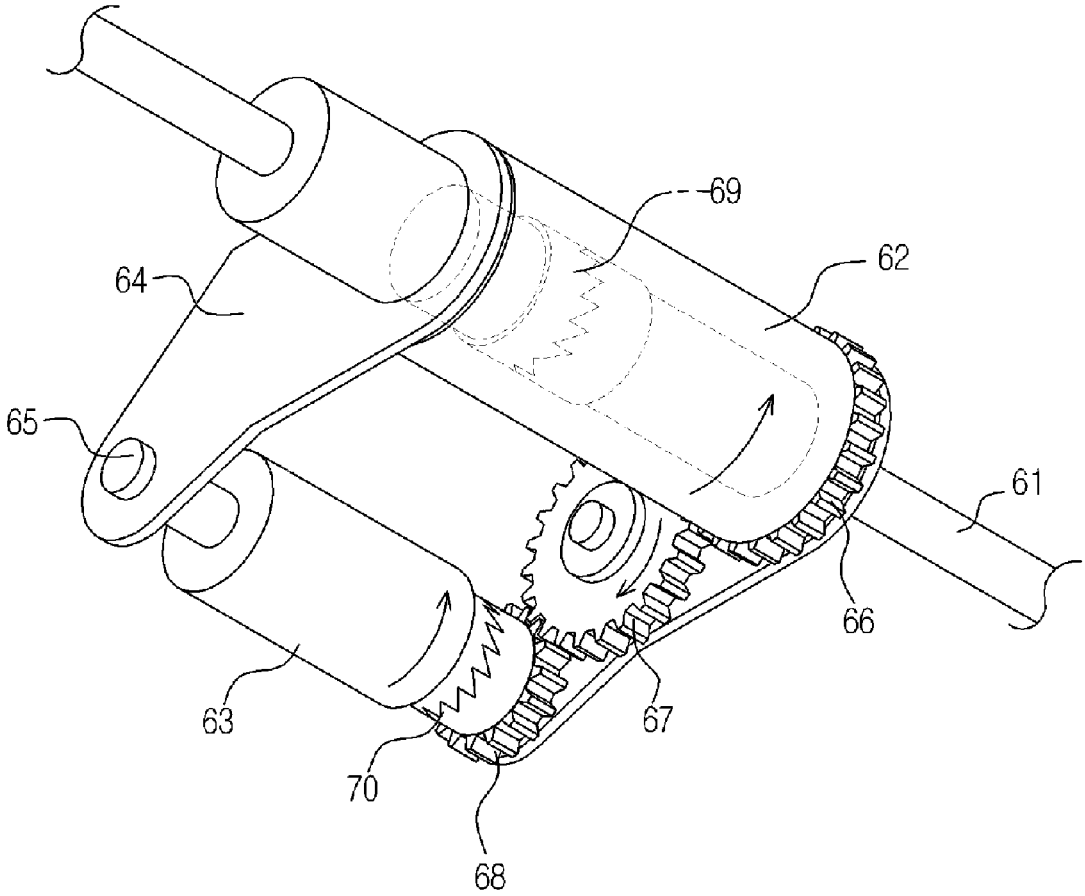
FIG. 3 is a perspective view of a pickup unit of the paper supply device according to an example embodiment of the present invention.

As shown in FIGS. 2 and 3, the pickup unit 60 includes a rotating shaft 61 mounted in the main body 1, a paper supply roller 62 coupled to the rotating shaft 61, a pickup roller 63 disposed above the paper at a distance from the paper supply roller 62, and a pickup frame 64 supporting the pickup roller 63 and rotating on the rotating shaft 61. The pickup roller 63 can rotate via a supporting shaft 65, both ends of which are coupled to the pickup frame 64. The pickup unit 60 further includes plural gears 66, 67, and 68, which transmit a rotational force applied to the paper supply roller 62 through the rotating shaft 61 to the pickup roller 63. As shown in FIG. 3, the gears include a driving gear 66 coupled to the paper supply roller 62, a driven gear 68 mounted adjacent to the pickup roller 63, and an intermediate gear 67 connecting the driving gear 66 and the driven gear 68. The intermediate gear 67 is rotatably mounted to the pickup frame 64.

Figure 6:
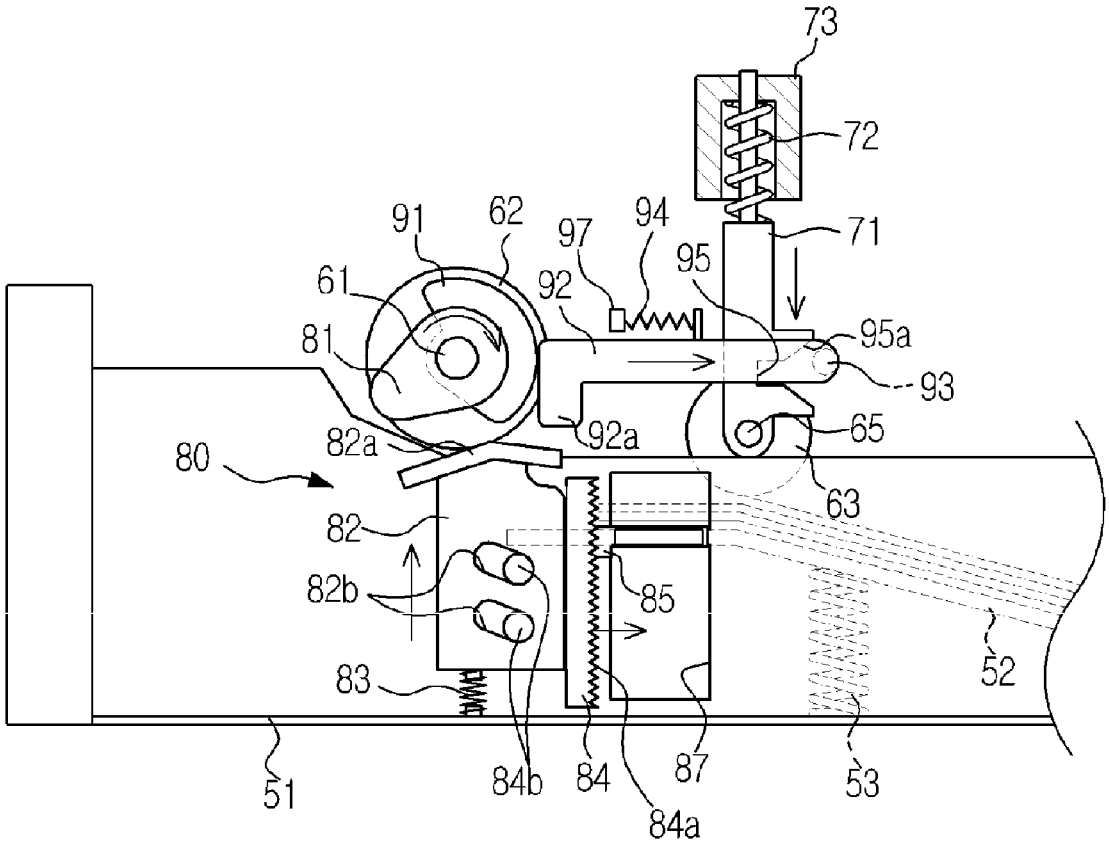
FIG. 6 is a sectional view illustrating a paper pickup state of the paper supply device according to an example embodiment of the present invention.

If the rotating shaft 61 rotates by a driving source (not shown), the pickup roller 63 rotates with the paper supply roller 62 and picks up the paper loaded in the paper supply cassette 51. As shown in FIG. 6, since the paper loaded in the paper supply cassette 51 contacts the pickup roller 63, the paper is picked up sheet by sheet by the rotation of the pickup roller 63, and is fed toward the feeding roller 11 by the operation of the paper supply roller 62. Although the driving source to rotate the rotating shaft 61 for the pickup operation is not shown, the driving source may be configured as, for example, a motor mounted in the main body 1.

Returning to FIG. 3, a first one-way clutch 69 is mounted to a coupling portion of the rotating shaft 61 and the paper supply roller 62, and a second oneway clutch 70 is mounted to a connecting portion of the pickup roller 63 and the driven gear 68. With this configuration, even if the paper supply roller 62 and the pickup roller 63 rotate while the paper goes out of the paper supply cassette 51 by the operation of the feeding roller 11 after the pickup operation, the rotation of the rollers 62 and 63 is not transmitted to the rotating shaft 61. When the rotating shaft 61 rotates for the pickup operation, the first one-way clutch 69 transmits the rotational force of the rotating shaft 61 to the paper supply roller 62, and the second one-way clutch 70 transmits the rotational force of the driven gear 68, which rotates by the operation of the paper supply roller 62, to the pickup roller 63. However, while the picked-up paper goes out of the paper supply cassette 51 after the pickup operation, the first and second one-way clutches 69 and 70 permit the paper supply roller 62 and the pickup roller 63 to rotate independently of the rotation of the rotating shaft 61. This is to secure smooth feeding of the paper. Since the constitution of the one-way clutch is well known, an explanation thereof will be omitted.

As shown in FIG. 2, the pickup unit 60 further includes a lifting member 71 and an elastic member 72. The lifting member 71 extends upward from the supporting shaft 65 so as to move up and down with the pickup roller 63. The elastic member 72 biases the lifting member 71 downward. The lifting member 71 extends upward by a predetermined length. An upper portion of the lifting member 71 is slidably inserted into a supporting part 73 provided in the main body 1. The lifting member 71 may be coupled to the pickup frame 64, adjacent to the pickup roller 63. The elastic member 72 may be configured as a coil spring that biases the lifting member 71 downward, and is disposed between an outer top surface of the lifting member 71 and the supporting part 73. If the up/down movement of the pickup unit 60 is not restrained by a second restraining device 90 (which will be described later), the elastic member 72 moves the pickup roller 63 down by the elastic force so that the pickup roller 63 can contact the upper surface of the paper, thereby providing the pickup roller 63 with the pickup force. Here, a pressure for picking up the paper is determined by the elastic force of the elastic member 72.

As shown in FIG. 2, the paper supply device 50 further includes a first restraining device 80 and a second restraining device 90. The first restraining device 90 restrains the paper supply plate 52 when the pickup roller 63 picks up the paper and releases the restraint of the paper supply plate 52 when the pickup roller 63 does not pick up the paper. The second restraining device 90 permits the pickup roller 63 to move up and down when the pickup roller 63 picks up the paper and restricts the up/down movement of the pickup roller 63 when the pickup roller 63 does not pick up the paper.

The first restraining device 80 includes a first rotating cam 81, a lifting cam 82, a first restoring spring 83, an advancing/retreating member 84, and a latching part 85. The lifting cam 82 is coupled to the rotating shaft 61 and rotates with the rotating shaft 61. The lifting cam 82 moves up and down by the operation of the first rotating cam 81. The first restoring spring 83 biases the lifting cam 82 upwardly toward the first rotating cam 81. The advancing/retreating member 84 advances and retreats in a direction perpendicular to the lifting cam 82 according to the up/down movement of the lifting cam 82, and has a tooth part 84*a* to restrain the paper supply plate 52. The latching part 85 is provided at the paper supply plate 52 to be latched by or released from the tooth part 84*a* according to the advancing and retreating of the advancing/retreating member 84.

The lifting cam 82 is provided with a contact portion 82*a* provided at an upper portion to come into contact with the first rotating cam 81 and plural inclined slots 82*b* positioned while opposing the advancing/retreating member 84 and having an inclination with respect to the up/down moving direction. An upper end of the first restoring spring 83 is coupled to a lower portion of the lifting cam 82. A lower end of the first restoring spring 83 is coupled to the paper supply cassette 51, thereby pushing up the lifting cam 82.

The advancing/retreating member 84 is coupled to a side surface of the paper supply cassette 51 so as to advance and retreat along a rail 86 provided on the side surface of the paper supply cassette 51, in the direction perpendicular to the up/down moving direction of the lifting cam 82. The advancing/retreating member 84 is provided with plural protrusions 84*b* that are fitted into the inclined slots 82*b* of the lifting cam 82. When the lifting cam 82 moves up and down, the advancing/retreating member 84 advances and retreats via the protrusions 84*b*, guided by the inclined slots 82*b*. The tooth part 84*a* of the advancing/retreating member 84 extends vertically long enough for the paper supply plate 52 to be latched thereto at an ascending position and a descending position. The paper supply plate 52 is provided with an extending portion 88 that extends outward through an opening portion 87 formed at the side surface of the paper supply cassette 51. The latching part 85 is coupled to the extending portion 88. The opening portion 87 formed at the side surface of the paper supply cassette 51 extends vertically long enough for the extending portion 88 to move up and down according to the up/down movement of the paper supply plate 52.

The first restraining device 80 operates as follows. If the lifting cam 82 is pressed by the first rotating cam 81, the lifting cam 82 moves down. If the lifting cam 82 moves down, the protrusions 84*b* of the advancing/retreating member 84 are guided by the inclined slots 82*b*, and the advancing/retreating member 84 moves away from the latching part 85. The latching part 85 is released from the tooth part 84*a* so that the paper supply plate 52 can move upward. If the paper supply plate 52 moves up, the sheets of paper loaded on the paper supply plate 52 also ascend, so that the uppermost paper contacts the pickup roller 63 and comes to a state capable of being picked up. If the pressing of the first rotating cam 81 on the lifting cam 82 is released, the lifting cam 82 moves up by the elastic force of the first restoring spring 83. The protrusions 84*b* of the advancing/retreating member 84 are guided by the inclined slots 82*b* in the reverse direction, and the advancing/retreating member 84 moves toward the latching part 85. The latching part 85 is latched by the tooth part 84*a*, and the paper supply plate 52 is restrained. In other words, the up/down movement of the paper supply plate 52 is restricted. As shown in FIG. 2, the first restraining device 80 can be provided in pairs at both sides of the paper supply cassette 51, so as to simultaneously restrain or release both sides of the paper supply plate 52.

The second restraining device 90 includes a second rotating cam 91 coupled to the rotating shaft 61, a restraining member 92, a second restoring spring 94, and a restraining recess 95. The restraining member 92 advances and retreats by the operation of the second rotating cam 91 and has a restraining protrusion 93 to restrain or release the lifting member 71. The second restoring spring 94 biases the restraining member 92 toward the second rotating cam 91. The restraining recess 95 formed at the lifting member 71, into which the restraining protrusion 93 is fitted to be latched thereby.

The second rotating cam 91 is mounted on the rotating shaft 61, adjacent to the paper supply roller 62. The second rotating cam 91 is formed in a semicircular shape or a fan shape so as to make the restraining member 92 advance and retreat by the rotation. The restraining member 92 is supported in the main body 1 so as to advance and retreat substantially in a paper supplying direction. Although not shown, an additional supporting member to support the restraining member 92 may be provided in the main body 1. The restraining member 92 is provided with a contact portion 92*a*, which is in contact with the second rotating cam 91, at one end portion. The restraining protrusion 93 is provided at the other end of the restraining member 92. The second restoring spring 94 is configured as a tension spring. One end of the second restoring spring 94 is coupled to the restraining member 92, and the other end is coupled to a spring supporting part 97 mounted in the main body 1.

Figure 5:
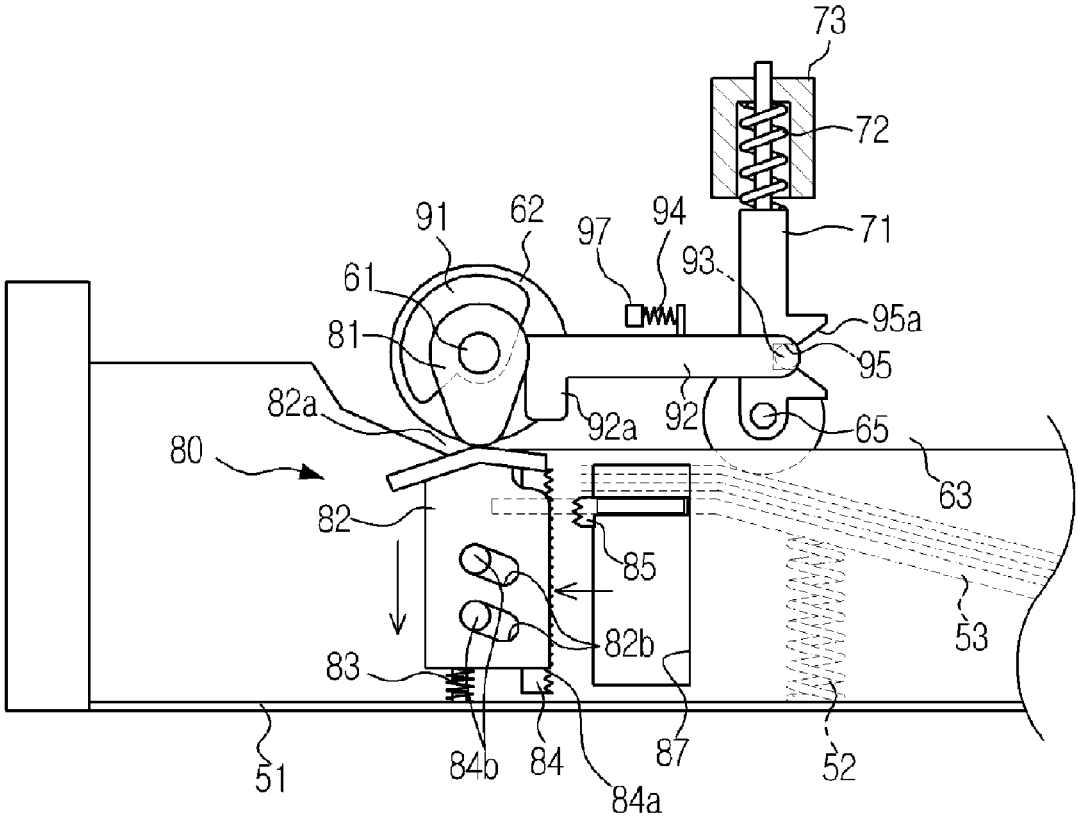
FIG. 5 is a sectional view illustrating a paper pickup standby state of the paper supply device according to an example embodiment of the present invention.

The restraining recess 95 formed at the lifting member 71 has an opening at one side so that when the restraining member 92 advances and retreats, the restraining protrusion 93 can fit into the restraining recess 95 to be latched thereby or released from the restraining recess 95. In order to secure the smooth fitting of the restraining protrusion 93 into the restraining recess 95, the restraining recess 95 may be provided with inclined guide surfaces 95*a*, as shown in FIG. 5. The inclined guide surfaces 95*a* are formed at upper and lower portions of the opening of the restraining recess 95, and are inclined so as to have an expanded opening. Besides the function of guiding the fitting of the restraining protrusion 93 into the restraining recess 95, the inclined guide surfaces 95*a* also have a function of moving the pickup roller 63 to an initial set position by guiding the lifting member 71 to ascend or descend when the restraining protrusion 93 restrains the lifting member 71.

Figure 4:
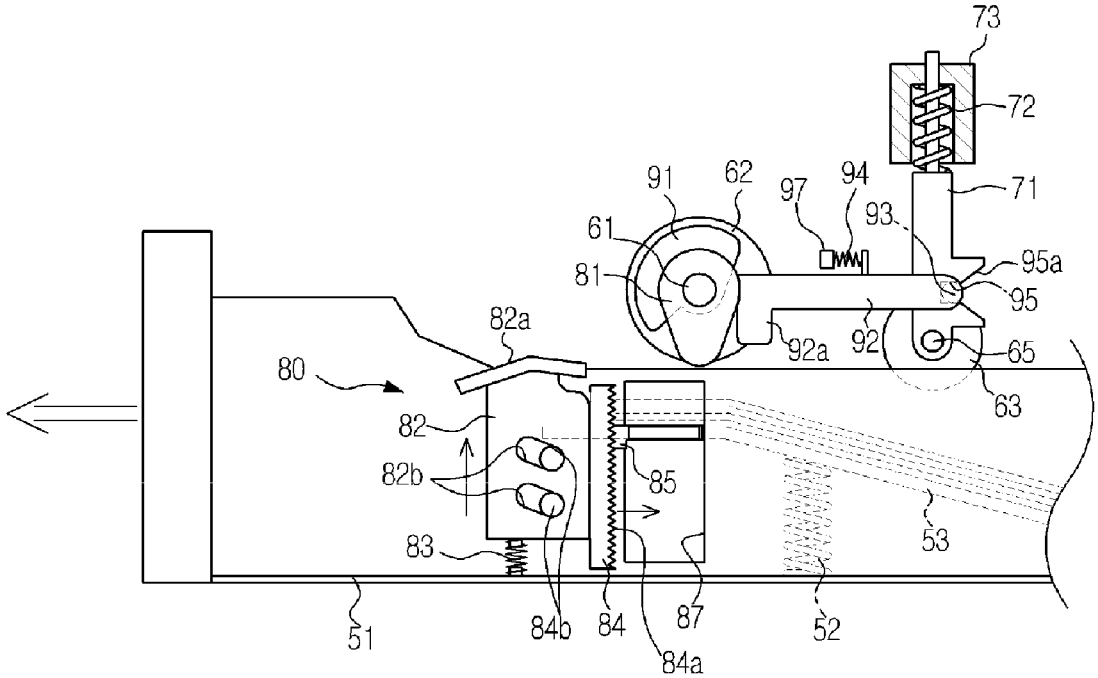
FIG. 4 is a sectional view illustrating a state in which the paper supply device is separated from a main body of the image forming apparatus according to an example embodiment of the present invention.

Hereinafter, the operation of the paper supply device according to an example embodiment of present invention will be described. As shown in FIG. 4, when the paper supply cassette 51 is removed from the main body 1 to so as to be loaded with additional paper, the lifting cam 82 of the first restraining device 80 separates from the first rotating cam 81, and the lifting cam 82 moves up by the elastic force of the first restoring spring 83. If the lifting cam 82 moves up, the advancing/retreating member 84 moves toward the latching part 85. Thus, since the latching part 85 of the paper supply plate 52 is latched by the tooth part 84*a* of the advancing/retreating member 84, the paper supply plate 52 is restrained so long as an external force is not applied. After adding additional paper to the paper supply cassette 51, if pushing down the sheets of paper, the paper supply plate 52 moves down. While the latching part 85 of the paper supply plate 52 is restrained by the tooth part 84*a*, if the external force is applied, the tooth part 84*a* is pushed away from the latching part 85. Once the paper supply plate 52 moves down, since the latching part 85 is latched again by the tooth part 84*a*, the paper supply plate 52 does not move up.

As shown in FIG. 5, after installing the paper supply cassette 51 in the main body 1 after supplementing the sheets of paper in the paper supply cassette 51, the lifting cam 82 is pushed down by the first rotating cam 81. Since the restraint of the paper supply plate 52 is released by the tooth part 84*a* of the advancing/retreating member 84 being separated from the latching part 85 of the paper supply plate 52, the paper supply plate 52 and the sheets of paper ascend. The restraining protrusion 93 of the restraining member 92 fits into the restraining recess 95 of the lifting member 71 and restrains the lifting member 71, preventing the pickup roller 63 from moving up and down. Accordingly, the uppermost paper comes into contact with the pickup roller 63, and does not ascend further. The paper comes to a pickup standby state.

As shown in FIG. 6, when the rotating shaft 61 rotates to pick up the paper, the paper supply roller 62 and the pickup roller 63 rotate, and the first rotating cam 81 and the second rotating cam 91 also rotate. Since the pressing of the first rotating cam 81 on the lifting cam 82 is released, the lifting cam 82 moves up, and the paper supply plate 52 is restrained by the ascending of the lifting cam 82. As soon as the paper supply plate 52 is restrained, the second rotating cam 91 pushes the restraining member 92 so that the restraining protrusion 93 separates from the restraining recess 95 of the lifting member 71, thereby releasing the restraint of the lifting member 71. Since the lifting member 71 is now capable of moving up and down, the elastic force of the elastic member 72 functions as the pickup force. In other words, the pressing force of the elastic member 72 on the pickup roller 63 becomes the pickup force. As described above, since the paper supply plate 52 is restrained at the moment the paper is picked up, the rising force of the press springs 53 has no influence on the pickup operation, and the elastic force of the elastic member 72 functions as the pickup force. Accordingly, the pickup force can be maintained constant regardless of the amount of loaded sheets of paper.

After performing the pickup operation, the first rotating cam 81 and the second rotating cam 91 rotate to the state shown in FIG. 5. Since the second rotating cam 91 does not press the restraining member 92, the restraining member 92 moves toward the second rotating cam 91 by the elastic force of the second restoring spring 94. The restraining protrusion 93 fits into the restraining recess 95 of the lifting member 71, and restrains the lifting member 71. When the restraining protrusion 93 is fitted into the restraining recess 95, since the inclined guide surfaces 95*a* formed at the opening of the restraining recess 95 guide the restraining protrusion 93, the restraining protrusion 93 can be fitted into the restraining recess 95 smoothly. Further, although the lifting member 71 is in a state that the lifting member 71 slightly moves up or down from the initial position, since the restraining protrusion 93 pushes up or pulls down the lifting member 71 while the restraining protrusion 93 is guided by the inclined guide surfaces 95*a*, the lifting member 71 is returned to the initial set position. Accordingly, the pickup roller 63 is positioned at the initial height.

As shown in FIG. 5, after the pickup operation, the first rotating cam 81 presses the lifting cam 82 again, and the lifting cam 82 moves down. The advancing/retreating member 84 moves away from the latching part 85, and the restraint of the paper supply plate 52 is released. Accordingly, the paper ascends with the paper supply plate 52.

As apparent from the above description, the paper supply device according to aspects of the present invention can maintain a constant paper pickup force. The moment the paper is picked up, the paper supply plate is restrained by the first restraining device, and the pickup roller of the pickup unit comes to a state capable of moving up and down. Accordingly, the rising force by the press springs has no influence on the pickup operation, and only the elastic force of the elastic member functions as the pickup force. In other words, the pickup force can be always maintained constant regardless of the amount of loaded sheets of paper.

Further, the paper supply device according to aspects of the present invention can more simplify the device for adjusting the height of the paper supply plate than a conventional device, because the first restraining device has the relatively simple constitution of the first rotating cam, the lifting cam, the advancing/retreating member having the tooth part, etc.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, the image forming apparatus may be a printer, a facsimile machine, a copier, a multifunction device, or other device capable of forming an image onto a printable medium. As discussed above, although aspects of the present invention may be used with paper, and the various components of the apparatus described above are described in terms of paper, any printable medium may be employed. The various components used in aspects of the present invention may be composed of any suitable material. Accordingly, it is intended, therefore, that the present invention not be limited to the various example embodiments disclosed, but that the present invention includes all embodiments falling within the scope of the appended claims.

What is claimed is:

1. A paper supply device comprising:

a paper supply cassette to load a printable medium;

a pickup unit to pick up the printable medium loaded in the paper supply cassette sheet by sheet;

a paper supply plate and a press spring arranged to bias the loaded printable medium toward the pickup unit;

at least one first restraining device to restrain the paper supply plate when the pickup unit picks up the printable medium and to release the paper supply plate when the pickup unit does not pick up the printable medium;

a second restraining device to permit the pickup unit to move vertically when the pickup unit picks up the printable medium and to restrict the vertical movement of the pickup unit when the pickup unit does not pick up the printable medium; and an elastic member to bias the pickup unit toward the printable medium so as to provide the pickup unit with a pickup force when the pickup unit picks up the printable medium, wherein the pickup unit comprises:

a rotating shaft rotating due to a driving source;

a paper supply roller coupled to the rotating shaft;

a pickup roller disposed above the printable medium at a distance from the paper supply roller, to pick up the printable medium in conjunction with the paper supply roller;

a pickup frame to support the pickup roller; and a lifting member connected to the pickup frame or a shaft of the pickup roller to move the pickup roller up and down; and wherein the second restraining device comprises:

a second rotating cam coupled to the rotating shaft;

a restraining member to advance and retreat by operation of the second rotating cam and having a restraining protrusion to restrain or release the lifting member;

a second restoring spring to bias the restraining member toward the second rotating cam; and a restraining recess formed at the lifting member so as to allow the restraining protrusion to fit into the restraining recess to be latched.

2. The paper supply device according to claim 1, wherein:

the pickup frame rotates on the rotating shaft so as to move the pickup roller up and down; and the lifting member is biased toward the printable medium by the elastic member so as to move the pickup roller up and down.

3. The paper supply device according to claim 2, wherein the first restraining device comprises:

a first rotating cam coupled to the rotating shaft;

a lifting cam to move up and down by operation of the first rotating cam;

a first restoring spring to bias the lifting cam toward the first rotating cam;

an advancing/retreating member to advance and retreat in a direction perpendicular to the lifting cam according to the up and down movement of the lifting cam and having a tooth part extending vertically to restrain the paper supply plate; and a latching part provided at the paper supply plate so as to be latched by or released from the tooth part according to operation of the advancing/retreating member so as to restrain or release the paper supply plate.

4. A paper supply device comprising:

a paper supply cassette to load a printable medium;

a pickup unit to pick up the printable medium loaded in the paper supply cassette sheet by sheet;

a paper supply plate and a press spring arranged to bias the loaded printable medium toward the pickup unit;

at least one first restraining device to restrain the paper supply plate when the pickup unit picks up the printable medium and to release the paper supply plate when the pickup unit does not pick up the printable medium;

a second restraining device to permit the pickup unit to move vertically when the pickup unit picks up the printable medium and to restrict the vertical movement of the pickup unit when the pickup unit does not pick up the printable medium; and an elastic member to bias the pickup unit toward the printable medium so as to provide the pickup unit with a pickup force when the pickup unit picks up the printable medium;

wherein the pickup unit comprises:

a rotating shaft rotating due to a driving source;

a paper supply roller coupled to the rotating shaft;

a pickup roller disposed above the printable medium at a distance from the paper supply roller, to pick up the printable medium in conjunction with the paper supply roller;

a pickup frame to support the pickup roller and to rotate on the rotating shaft so as to move the pickup roller up and down; and a lifting member connected to the pickup frame or a shaft of the pickup roller and biased toward the printable medium by the elastic member so as to move the pickup roller up and down, wherein the first restraining device comprises:

a first rotating cam coupled to the rotating shaft;

a lifting cam to move up and down by operation of the first rotating cam;

a first restoring spring to bias the lifting cam toward the first rotating cam;

an advancing/retreating member to advance and retreat in a direction perpendicular to the lifting cam according to the up and down movement of the lifting cam and having a tooth part extending vertically to restrain the paper supply plate; and a latching part provided at the paper supply plate so as to be latched by or released from the tooth part according to operation of the advancing/retreating member so as to restrain or release the paper supply plate, wherein the lifting cam comprises at least one inclined slot having an inclination with respect to an up/down moving direction, and wherein the advancing/retreating member comprises at least one protrusion that is fitted into the inclined slot.

5. The paper supply device according to claim 3, wherein the first restraining device includes a plurality of first restraining devices respectively provided at two sides of the paper supply cassette.

6. The paper supply device according to claim 1, wherein the restraining recess is provided with inclined guide surfaces formed at an opening of the restraining recess and inclined so as to have an expanded opening to ensure smooth fitting of the restraining protrusion.

7. The paper supply device according to claim 2, wherein the pickup unit comprises:

a plurality of gears to transmit a rotational force of the paper supply roller to the pickup roller; and oneway clutches provided at a coupling portion of the rotating shaft and the paper supply roller and a connecting portion of the pickup roller and the plurality of gears.

8. An image forming apparatus comprising:

an image forming unit to form an image onto a printable medium; and a paper supply device to supply the paper to the image forming unit, the paper supply device including:

a paper supply cassette to load the printable medium, a pickup unit to pick up the printable medium loaded in the paper supply cassette sheet by sheet, a paper supply plate and a press spring to bias the loaded printable medium toward the pickup unit, a first restraining device to restrain the paper supply plate when the pickup unit picks up the printable medium and to release the paper supply plate when the pickup unit does not pick up the printable medium, a second restraining device to permit the pickup unit to move up and down when the pickup unit picks up the printable medium and to restrict the movement of the pickup unit when the pickup unit does not pick up the printable medium, and an elastic member to bias the pickup unit toward the printable medium so as to provide the pickup unit with a pickup force when the pickup unit picks up the printable medium;

wherein the pickup unit comprises:

a rotating shaft to rotate due to a driving source;

a paper supply roller coupled to the rotating shaft;

a pickup roller disposed above the printable medium at a distance from the paper supply roller to pick up the printable medium in conjunction with the paper supply roller;

a pickup frame to support the pickup roller; and a lifting member connected to the pickup frame or a shaft of the pickup roller; and wherein the second restraining device comprises:

a second rotating cam coupled to the rotating shaft;

a restraining member to advance and retreat by operation of the second rotating cam and having a restraining protrusion to restrain or release the lifting member;

a second restoring spring to bias the restraining member toward the second rotating cam; and a restraining recess formed at the lifting member to fit into the restraining recess so as to be latched.

9. The image forming apparatus according to claim 8, wherein the pickup frame rotates on the rotating shaft so as to move the pickup roller up and down; and a lifting member is biased toward the printable medium by the elastic member.

10. The image forming apparatus according to claim 9, wherein the first restraining device comprises:

a first rotating cam coupled to the rotating shaft;

a lifting cam to move up and down by operation of the first rotating cam;

a first restoring spring to bias the lifting cam toward the first rotating cam;

an advancing/retreating member to advance and retreat in a direction perpendicular to the lifting cam according to the movement of the lifting cam and having a tooth part extending vertically to restrain the paper supply plate; and a latching part provided at the paper supply plate so as to be latched by or released from the tooth part according to operation of the advancing/retreating member so as to restrain or release the paper supply plate.

11. An image forming apparatus comprising:

an image forming unit to form an image onto a printable medium; and a paper supply device to supply the paper to the image forming unit, the paper supply device including:

a paper supply cassette to load the printable medium, a pickup unit to pick up the printable medium loaded in the paper supply cassette sheet by sheet, a paper supply plate and a press spring to bias the loaded printable medium toward the pickup unit, a first restraining device to restrain the paper supply plate when the pickup unit picks up the printable medium and to release the paper supply plate when the pickup unit does not pick up the printable medium, a second restraining device to permit the pickup unit to move up and down when the pickup unit picks up the printable medium and to restrict the movement of the pickup unit when the pickup unit does not pick up the printable medium, and an elastic member to bias the pickup unit toward the printable medium so as to provide the pickup unit with a pickup force when the pickup unit picks up the printable medium;

wherein the pickup unit comprises:

a rotating shaft to rotate due to a driving source;

a paper supply roller coupled to the rotating shaft;

a pickup roller disposed above the printable medium at a distance from the paper supply roller to pick up the printable medium in conjunction with the paper supply roller;

a pickup frame to support the pickup roller and to rotate on the rotating shaft so as to move the pickup roller up and down; and a lifting member connected to the pickup frame or a shaft of the pickup roller and biased toward the printable medium by the elastic member, wherein the first restraining device comprises:

a first rotating cam coupled to the rotating shaft;

a lifting cam to move up and down by operation of the first rotating cam;

a first restoring spring to bias the lifting cam toward the first rotating cam;

an advancing/retreating member to advance and retreat in a direction perpendicular to the lifting cam according to the movement of the lifting cam and having a tooth part extending vertically to restrain the paper supply plate; and a latching part provided at the paper supply plate so as to be latched by or released from the tooth part according to operation of the advancing/retreating member so as to restrain or release the paper supply plate, wherein the lifting cam includes at least one inclined slot having an inclination with respect to an up/down moving direction; and wherein the advancing/retreating member includes at least one protrusion to fit into the inclined slot.

12. The image forming apparatus according to claim 8, wherein the restraining recess is provided with inclined guide surfaces formed at an opening of the restraining recess and inclined as to have an expanded opening to ensure smooth fitting of the restraining protrusion.

13. The image forming apparatus according to claim 9, wherein the pickup unit comprises;

a plurality of gears to transmit a rotational force of the paper supply roller to the pickup roller; and oneway clutches provided at a coupling portion of the rotating shaft and the paper supply roller and a connecting portion of the pickup roller and the plurality of gears.

14. An image forming apparatus comprising:

an image forming unit to form an image onto a printable medium;

a paper supply device to store the printable medium;

a pickup unit to pick up the printable medium from the paper supply device;

a feeding unit to feed the printable medium from the pickup unit to the image forming unit;

a fusing unit to fuse the image onto the printable medium; and a discharge unit to discharge the printable medium after the image is formed onto the printable medium;

wherein the paper supply device comprises a paper supply cassette to store the printable medium, a paper supply plate to supply the printable medium to the pickup unit, a first restraining device to restrain or release the paper supply plate based on whether the pickup roller picks up the printable medium, and a second restraining device to allow or restrict up/down movement of the pickup roller based on whether the pickup unit is picking up the printable medium;

wherein the pickup unit comprises:

a rotating shaft;

a pickup roller disposed above the printable medium to pick up the printable medium;

a paper supply roller arranged at a distance from the pickup roller to pick up the printable medium in conjunction with the pickup roller;

a pickup frame to support the pickup roller and to rotate on the rotating shaft so as to move the pickup roller up and down;

an elastic member to bias the pickup roller toward the printable medium; and a lifting member connected to the pickup frame or to a shaft of the pickup roller and biased toward the printable medium by the elastic member so as to move the pickup roller up and down; and wherein the second restraining device comprises:

a rotating cam coupled to the rotating shaft;

a restraining member to advance and retreat according to the operation of the rotating cam and having a restraining protrusion to restrain or release the lifting member;

a restoring spring to bias the restraining member toward the rotating cam; and a restraining recess formed in the lifting member to allow the restraining protrusion to fit into the restraining recess to be latched, so as to restrain the movement of the pickup roller.

15. The image forming apparatus according to claim 14, wherein the pickup unit further comprises:

an elastic member to bias the pickup roller toward the printable medium; and wherein the pickup frame rotates on the rotating shaft so as to move the pickup roller up and down;

and wherein the lifting member is biased toward the printable medium by the elastic member so as to move the pickup roller up and down.

16. The image forming apparatus according to claim 14, wherein the first restraining device comprises:

a rotating cam coupled to a rotating shaft of the pickup unit;

a lifting cam to be moved up and down by the rotating cam;

a restoring spring to bias the lifting cam toward the rotating cam;

an advancing/retreating member to advance and retreat according to the movement of the lifting cam in a direction perpendicular to the lifting cam, and having teeth to restrain the paper supply plate; and a latching part coupled to the paper supply plate and arranged so as to latch or release from the teeth according to the operation of the advancing/retreating member, so as to restrain or release the paper supply plate.

17. An image forming apparatus comprising:

an image forming unit to form an image onto a printable medium;

a paper supply device to store the printable medium;

a pickup unit to pick up the printable medium from the paper supply device;

a feeding unit to feed the printable medium from the pickup unit to the image forming unit;

a fusing unit to fuse the image onto the printable medium; and a discharge unit to discharge the printable medium after the image is formed onto the printable medium;

wherein the paper supply device comprises a paper supply cassette to store the printable medium, a paper supply plate to supply the printable medium to the pickup unit, a first restraining device to restrain or release the paper supply plate based on whether the pickup roller picks up the printable medium, and a second restraining device to allow or restrict up/down movement of the pickup roller based on whether the pickup unit is picking up the printable medium, wherein the first restraining device comprises:

a rotating cam coupled to a rotating shaft of the pickup unit;

a lifting cam to be moved up and down by the rotating cam;

a restoring spring to bias the lifting cam toward the rotating cam;

an advancing/retreating member to advance and retreat according to the movement of the lifting cam in a direction perpendicular to the lifting cam, and having teeth to restrain the paper supply plate; and a latching part coupled to the paper supply plate and arranged so as to latch or release from the teeth according to the operation of the advancing/retreating member, so as to restrain or release the paper supply plate;

wherein the lifting cam comprises at least one inclined slot; and wherein the advancing/retreating member comprises at least one protrusion formed so as to fit into the at least one inclined slot, so as to engage and disengage the advancing/retreating member with the latching part.

18. A paper supply device comprising:

a paper supply cassette to load a printable medium;

a pickup unit to pick up the printable medium loaded in the paper supply cassette, the pickup unit including a rotating shaft to rotate due to a driving source, a pickup frame to rotate about the rotating shaft, and a pickup roller rotatably mounted to the pickup frame;

a paper supply plate and a press spring to bias the loaded printable medium toward the pickup unit;

a first restraining device to restrain or release the paper supply plate in accordance with whether or not the pickup unit picks up the printable medium, the first restraining device including a first rotating cam coupled to the rotating shaft, to operate by rotation of the rotating shaft;

a second restraining device to permit or restrict movement of the paper supply plate in accordance with whether or not the pickup unit picks up the printable medium, the second restraining device including a second rotating cam coupled to the rotating shaft, to operate by rotation of the rotating shaft; and an elastic member to bias the pickup unit toward the printable medium wherein the second restraining device permits the pickup unit to move vertically when the first restraining device restrains the paper supply plate, and restricts the vertical movement of the pickup unit when the first restraining device releases the paper supply plate.

* * * * *

UNITED STATES PATENT AND TRADEMARK OFFICE

CERTIFICATE OF CORRECTION

PATENT NO. : 7,648,134 B2
APPLICATION NO. : 12/055374
DATED : January 19, 2010
INVENTOR(S) : Kwang Taek Lim It is certified that error appears in the above-identified patent and that said Letters Patent is hereby corrected as shown below:

Column 14, Line 37, change "comprises;" to --comprises:--.

Signed and Sealed this

Twentieth Day of April, 2010

David J. Kappos

David J. Kappos
*Director of the United States Patent and Trademark Office*